US006394837B1

(12) United States Patent
Edwards et al.

(10) Patent No.: US 6,394,837 B1
(45) Date of Patent: May 28, 2002

(54) ELECTRICAL CONNECTOR SYSTEM

(75) Inventors: Jeffrey Charles Edwards, Lound; William George Nigel Parkinson Webster, Aberdeen, both of (GB)

(73) Assignee: Expro North Sea Limited (GB)

( * ) Notice: Subject to any disclaimer, the term of this patent is extended or adjusted under 35 U.S.C. 154(b) by 0 days.

(21) Appl. No.: 09/830,728

(22) PCT Filed: Oct. 28, 1999

(86) PCT No.: PCT/GB99/03567

§ 371 Date: Jun. 14, 2001

§ 102(e) Date: Jun. 14, 2001

(87) PCT Pub. No.: WO00/26998

PCT Pub. Date: May 11, 2000

(30) Foreign Application Priority Data

Oct. 30, 1998 (GB) ..... 9826630

(51) Int. Cl.[7] ..... H01R 13/629

(52) U.S. Cl. ..... 439/426; 439/310; 166/338; 166/65.1

(58) Field of Search ..... 439/424, 426, 439/190, 191, 192, 193, 194, 195, 197, 199, 178, 179; 285/123, 125, 150, 219; 166/45

(56) References Cited

U.S. PATENT DOCUMENTS 3,638,732 A * 2/1972 Huntssinger et al. ..... 166/315
4,448,466 A * 5/1984 Porter ..... 339/17
4,491,176 A * 1/1985 Reed ..... 166/65
4,589,492 A * 5/1986 Greiner et al. ..... 166/338
4,859,196 A * 8/1989 Durando et al. ..... 439/197
5,174,765 A * 12/1992 Williams et al. ..... 439/86
5,749,608 A * 5/1998 Wilkins et al. ..... 285/123
6,200,152 B1 * 3/2001 Hopper ..... 439/310

* cited by examiner

*Primary Examiner*—Gary Paumen
*Assistant Examiner*—Alexander Gilman
(74) *Attorney, Agent, or Firm*—Gifford, Krass, Groh, Sprinkle, Anderson & Citkowski, P.C.

(57) ABSTRACT

An electrical connector system is described for use in subsea environments for providing electrical connection through the wellhead into a tubular element with apertures for carrying electrical cables downhole. The system includes a circumferential electrically conductor ring which is coupled to, and insulated from, a tubular subsea element such as a tubing hanger, by an elastomeric electrically insulating sealing element, surrounding the conductor ring. The conductor ring is coupled to an electrical annular connector and is adapted to receive an electrical connector of a horizontally mounted electrical connector assembly which is hydraulically actuated to penetrate the elastomeric element in the direction transverse to the longitudinal axis of the tubular element to make electrical contact with the conductor ring. This completes an electrical connection from the electrical connector assembly through the conductor ring to the annular connector which, in turn, is coupled to a cable connected to downhole transducers or electrical equipment. The tubular element and conductor ring fit within a wellhead or tubular casing which has an aligned aperture for receiving the horizontally mounted electrical connector assembly.

16 Claims, 2 Drawing Sheets

ELECTRICAL CONNECTOR SYSTEM

FIELD OF THE INVENTION

The present invention relates to an electrical connector system for use particularly, but not exclusively, in the oil industry. The electrical connector system is particularly suitable for use as a wellhead connector system used in subsea downhole environments for providing electrical connection through the wellhead into a tubular element with apertures for carrying electrical cables downhole.

BACKGROUND OF THE INVENTION

Electrical connections are required in subsea equipment so that electrical signals can pass to the subsea completion systems allowing signals to be relayed between downhole transducers and the surface for example, from permanent monitoring equipment. The signals can also be used to provide information to allow intelligent completion control of wells. Electrical connections are typically provided in prior art systems using a vertical stab arrangement. This is an arrangement where tubular elements typically have a plurality of male electrical connectors extending from the end of one tubular element for mating with corresponding female electrical connectors on an adjacent electrical element. Although such vertical stab elements are commonplace and generally work well, they suffer from the significant disadvantage that careful orientation is required before the connections are made up otherwise, if an attempt is made to mate two adjacent pieces of equipment together when the connectors are out of registration, this can result in damage to the connectors, subsequent retrieval of part, or all, of the connecting equipment being necessary. Orientation is often time-consuming and difficult depending on the equipment used and the particular well conditions. A further disadvantage with the vertical stab arrangement is that it often requires multiple parallel channels to be made through each tubular element which is expensive and can be difficult when relatively thin walled elements are required leading to a restriction in the number of cables and consequently monitoring arrangements.

An object of the present invention is to provide an improved electrical connector system which obviates or mitigates at least one of the aforementioned disadvantages.

This is achieved in the most general sense by providing a circumferentially electrically conductor ring which is coupled to, and insulated from, a tubular subsea element such as a tubing hanger, partly by an elastomeric electrically insulating sealing element, surrounding the conductor ring. The conductor ring is coupled to an electrical annular connector and is adapted to receive an electrical connector of a horizontally mounted electrical connector assembly which is hydraulically activated to penetrate the elastomeric element in the direction transverse to the longitudinal axis of the tubular element.

The tubular element, such as a tubing hanger, is machined to receive the conductor ring assembly which includes a conductor ring. The tubular element and conductor ring fit within a wellhead or tubular casing which has an aligned aperture for receiving the horizontally mounted electrical connector assembly. The electrical connector assembly is actuatable to cause an electrical connector/penetrator to be moved towards the conductor ring assembly so as to penetrate the elastomeric insulating ring and consequently makes electrical contact with the conductor ring to complete an electrical connection from the electrical connector assembly through the conductor ring to the annular connector which, in turn, is coupled to a cable connected to downhole transducers or electrical equipment.

Removal of the electrical connector/penetrator results in the elastomeric ring self-sealing to prevent well fluids connecting with the conductor ring and providing an electrical short circuit.

The electrical connector/penetrator is hydraulically operated and is also spring-biased such that in the absence of any hydraulic pressure to the connector assembly, the spring is biased to force the electrical penetrator into contact with the conductor ring to provide an electrical contact in the event of hydraulic pressure failure.

According to a first aspect of the present invention, there is provided a wellhead electrical connector system for use with a wellhead, said electrical connector system having a tubing hanger for location in said wellhead, said tubing hanger having a circumferential electrical conductor ring assembly disposed at one end thereof, said electrical conductor ring assembly having an electrical conductor ring which is electrically insulated from the tubing hanger housing, a circumferential elastomeric sealing ring disposed about the said electrical conductor ring for electrically insulating said conductor ring from the tubing hanger and from the external environment, said tubing hanger having at least one electrical connector disposed in the tubular wall thereof for conveying electrical signals to electrical conductors adapted to be coupled thereto, said elastomeric insulated sealing ring being penetrable by an energisable electrical connector coupled to the wellhead to contact said conductor ring and provide an electrical connection from the energisable electrical connector through the tubing hanger to said at least one electrical connector disposed within said tubing hanger.

Preferably, the tubing hanger has a machined upper end for receiving the conductor ring assembly, such that when the conductor ring assembly is fitted to the tubing hanger, the external diameter of the tubing hanger is substantially the same as prior to machining the tubing hanger.

Preferably also, the conductor ring assembly has an annular structure with the conductor ring and elastomeric ring being retained between a lower conductor ring housing and an upper retaining ring, the elastomeric element being forced onto the conductor ring via an upper retainer ring acting through a spring onto a spring energiser ring which abuts the circumferential elastomeric sealing ring. The entire assembly is retained by an upper annular hanger lock ring which forces the retainer ring and spring and spring energiser ring against the elastomeric element.

Conveniently, the elastomeric ring is shaped to allow expansion when compressed by the retainer ring so as to provide effective sealing against the interior surface of the wellhead and minimise the intrusion of well fluids between the elastomeric sealing ring surface and the opposed surface of the interior of the wellhead.

Conveniently, the springs are wave or disc springs. Preferably, the elastomeric element is a machined or moulded element.

Conveniently, the electrical connector system is electrically coupled to a multi-way connector (i.e. Tronic, U.K.) for conveying electrical signals from a source external to the connector assembly through the connector assembly to the conductor ring when in use. Advantageously, the electrical penetrator is coupled to a manual/ROV override boss which allows the penetrator to be disengaged from the conductor ring in the event of hydraulic failure.

According to a further aspect of the present invention, there is provided a method of providing electrical connection through a tubular element, said method comprising the steps of, machining a tubular element to provide an annular recessed area, fitting an electrical conductor ring assembly into the recessed area, disposing an electrical connector assembly having a moveable electrical connecting element at a predetermined location external to the tubular element, actuating the electrical connecting element in a direction substantially transverse to the longitudinal axis of the tubular element to make electrical contact with the conductor ring assembly whereby electrical connection through said conductor assembly such that electrical signals pass from outside the tubular element in a transverse direction via said conductor ring assembly to electrical connectors within said tubular element.

Preferably, the method includes the step of biasing the electrical connector assembly such that in the event of hydraulic failure or actuation of the electrical connector penetrator, resilient means urge the electrical penetrator into electrical contact with said conductor ring.

Preferably, said method includes the step of sealing said conductor ring by said elastomeric ring upon removal of the electrical penetrator.

Preferably, the tubular element is a tubing hanger disposed in a wellhead.

According to a further aspect of the invention, there is provided an electrical conductor ring assembly for use with a downhole tubular element having an electrical connector in a wall thereof and at least one annular bore for receiving an electrical conductor, said conductor ring assembly being adapted to be coupled to said tubular element, said conductor ring assembly having a generally circumferential conductor ring element, a generally circumferential insulating element for electrically insulating said conductor ring assembly from the tubular element, a generally circumferential elastomeric electrically insulating element adapted to be disposed radially externally to the conductor ring assembly for effectively sealing the conductor ring assembly from external well fluids, the conductor ring assembly having upper and lower support means for urging said elastomeric element into contact with said conductor ring, said conductor ring assembly being adapted to be coupled to an electrical conductor for fitting into said bore of said tubular element, said elastomeric sealing ring being resilient such that it deforms to allow an electrical penetrator to make electrical contact with said conductor ring, and upon the removal of said electrical penetrator, the elastomeric sealing element recovers to seal the previously penetrated area.

According to a yet further aspect of the present invention there is provided a non-orientation required electrical connector system for use with concentric tubular elements coupled together for use within a well, said electrical connector system having a first and a second tubular element for location in said well, said first tubular element having a first coupling portion of a first diameter having a generally circumferentially extending electrical conductor ring assembly disposed at said portion, said electrical conductor ring assembly having an electrical conductor ring which is electrically insulated from the first tubular element housing, a generally circumferential elastomeric sealing ring disposed about the said electrical conductor ring for electrically insulating said conductor ring from the first tubular element and from the external environment, said first tubular element having at least one electrical connector disposed in a wall of said first tubular element thereof for conveying electrical signals to electrical conductors adapted to be coupled thereto, said second tubular element having a second coupling portion of a second diameter different from said first diameter portion and being adapted to be coupled to the first coupling portion of said first tubular element, said second tubular element having an energisable electrical connector coupled thereto, the arrangement being such that when said first and second tubular elements are coupled together at said first and second coupling portion, said energisable electrical connector penetrates said elastomeric insulated sealing ring to contact said conductor ring and provide an electrical connection from the energisable electrical connector from the second tubular element to said at least one electrical conductor within said first tubular element.

BRIEF DESCRIPTION OF THE DRAWINGS

These and other aspects of the present invention will become apparent from the following description when taken in combination with the accompanying drawings in which.

DETAILED DESCRIPTION OF THE PREFERRED EMBODIMENTS

Figure 1:
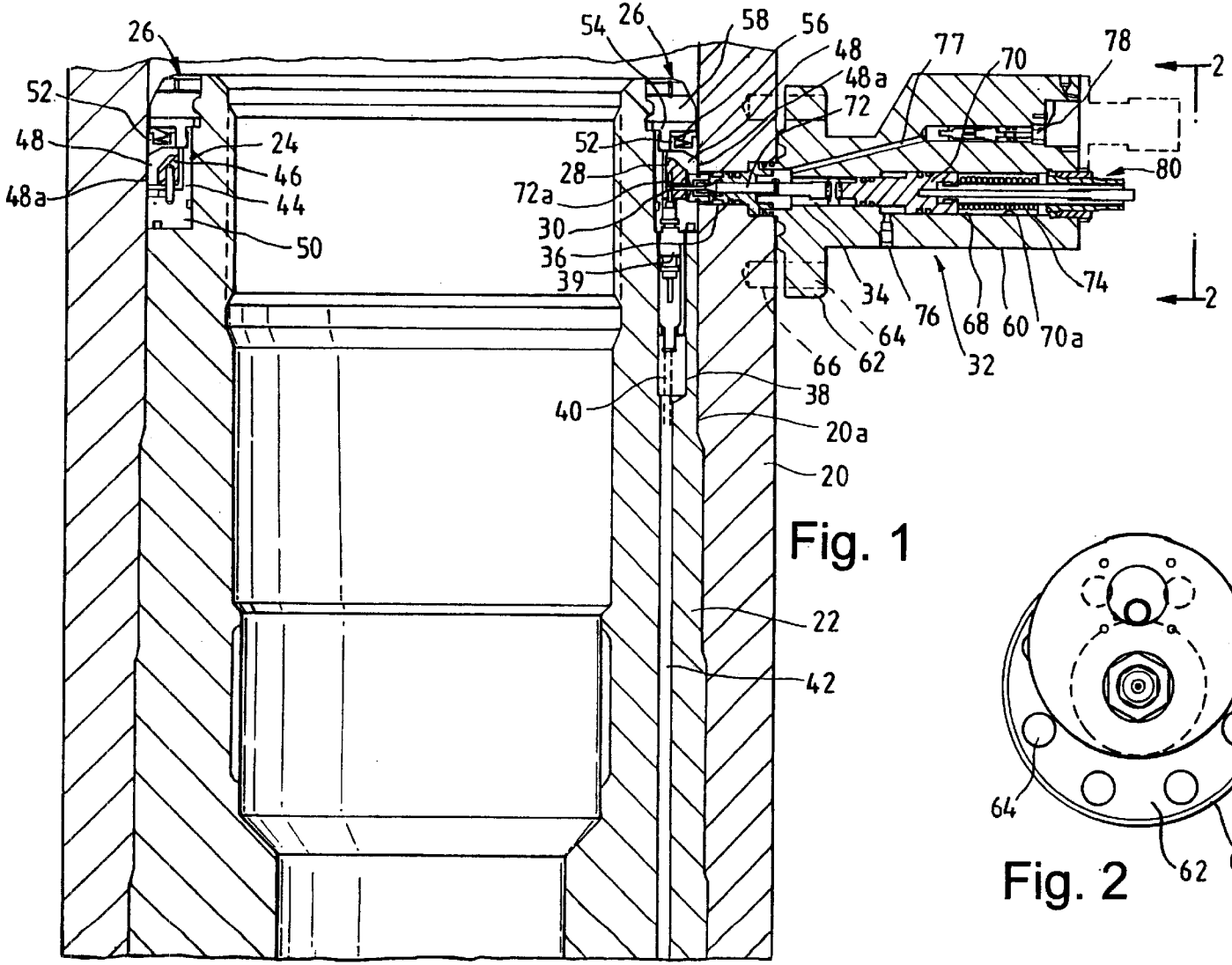
FIG. 1 is a diagrammatic cross-sectional view through a wellhead with a tubing hanger mounted therein and a connector assembly mounted at the side of the wellhead in accordance with an embodiment of the present invention.

Reference is first made to FIG. 1 of the drawings which depicts the top part of a wellhead, generally indicated by reference numeral 20, into which is located a tubing hanger 22, in a conventional manner. The top of the tubing hanger 22 has been machined to define an annular recess 24 into which is disposed a conductor ring assembly, generally indicated by reference numeral 26, which has a circumferential conductor ring 28 for being electrically connected to an electrically conductive penetrator 30 of an electrical connector assembly, generally indicated by reference numeral 32, which is mounted on the side of the wellhead 20 as shown. When the electrical connector assembly is actuated, a spring-biased electrical connector/penetrator 34 is urged through an aperture 36 in the wellhead to penetrate the conductor ring assembly 26 and mate with the conductor ring 28 for providing electrical contact, as will be later described in detail.

Figure 3:
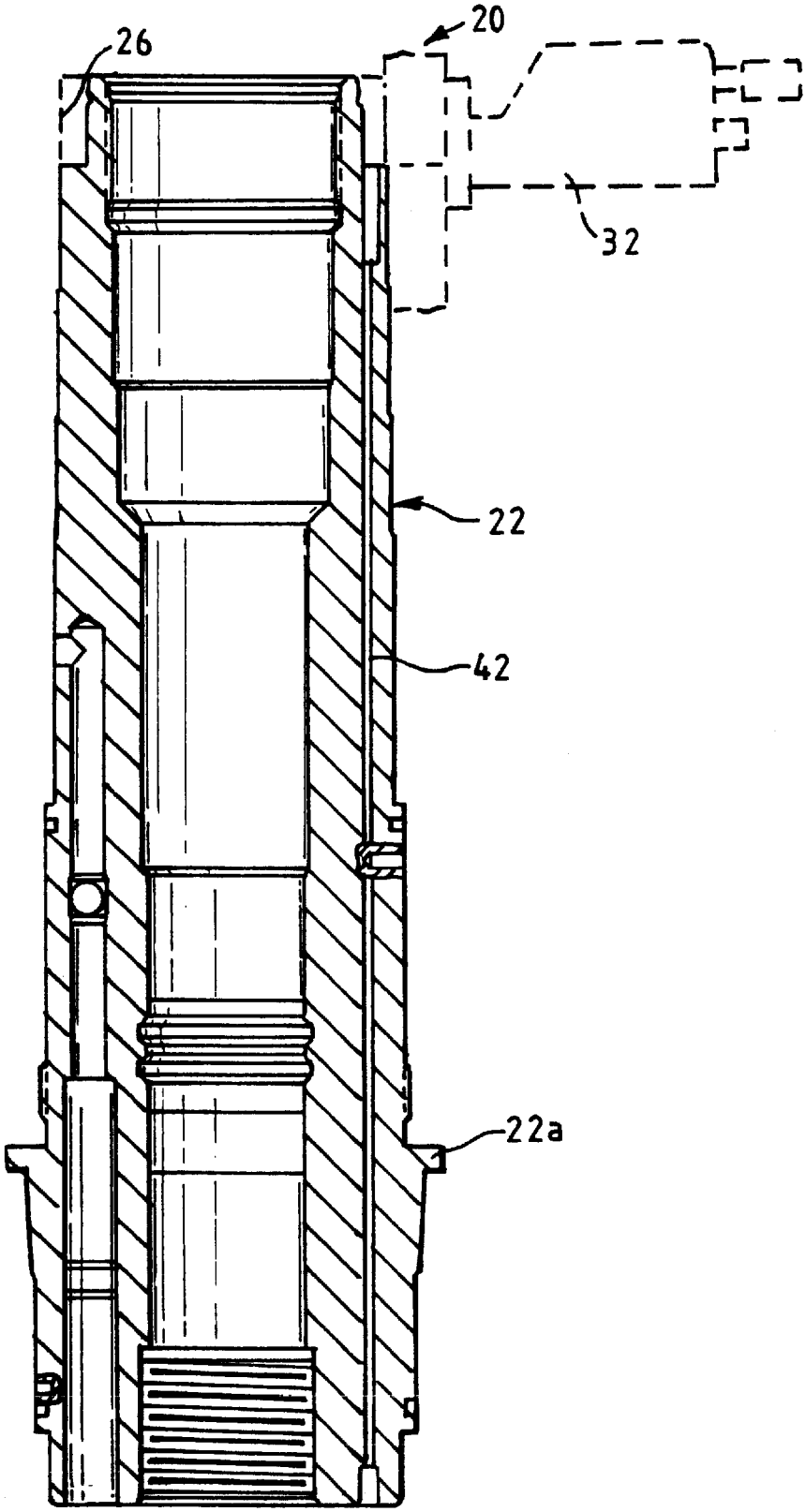
FIG. 3 is a cross-sectional view of the complete tubing hanger shown in FIG. 1, but to a reduced scale, with the conductor ring assembly and the electrical connector assembly shown in broken outline only.

It will be seen from FIG. 1 that the tubing hanger 22 has an upper bore 38 for receiving an electrical connector 39 which is coupled between the circumferential conductor ring 28 of the conductor ring assembly 26 and an electrical cable 40 as shown in broken outline. The bore 38 narrows into a longitudinal bore 42 which extends throughout the length of the tubing hanger 22 as best seen in FIG. 3 of the drawings. The cable 40 passes through bore 42 for subsequent connection to a further cable or transducers downstream of the tubing hanger 22.

The conductor ring assembly 26 is dimensioned and proportioned to fit into the annular recess 24 and the tubing hanger 22 as shown in FIG. 1 of the drawings, such that the tubing hanger, when fitted with the conductor ring, fits readily within the wellhead 20 as shown in FIG. 1.

The conductor ring assembly 26 has a circumferential copper conducting ring 28 which is electrically insulated from conductive ring housing 44 by an electrical insulator 46 at its radially inward position and also beneath the conductor ring 28.

A machined elastomeric ring 48 is disposed around the conductor ring 28 above and radially outwardly of conductor ring 28 as shown in FIG. 1 of the drawings. The elastomeric ring 48 is effectively sandwiched between the conductor ring housing 44 and an upper energiser ring 52 and a retainer ring 54 which screws into housing 44. A wave spring 56 is disposed between the retainer ring 54 and the energiser ring 52 for urging the energiser ring 52 against the elastomeric element 48. A hanger lock ring 58 locks the retainer ring 54 in place to prevent inadvertent unscrewing of the assembly during tool makeup.

When the retainer ring 54 is screwed into the conductor housing 44 it urges the energiser ring 52 against the elastomeric seal 48 thereby deforming the elastomeric seal so that it forces face 48*a* slightly proud of the surface of the tubing hanger so that there is a tight fit against the interior surface 20*a* of the wellhead to provide an effective seal against well fluids, but not tight enough to prevent entry of the tubing hanger into the wellhead or damage to elastomeric seal.

Figure 2:
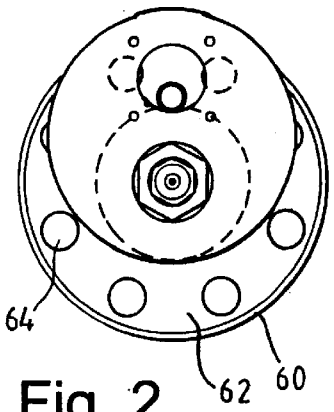
FIG. 2 is an end view of FIG. 1 taken on the lines 2—2.

Reference is now made to the electrical connector assembly, generally indicated by reference numeral 32. It will be seen that this consists of a housing 60 which is generally cylindrical, as best seen in FIG. 2. The housing has a front circular plate 62 with a plurality of apertures 64 which are aligned with corresponding apertures 66 in the wellhead to allow the assembly 32 to be bolted to the wellhead by bolts (not shown).

Disposed within the assembly 32 is a bore 68 into which is disposed a plunger 70. The plunger 70 has at one end an electrical penetrator/connector, generally indicated by reference numeral 72, which has a leading conductor end 72*a* which is shown in electrical contact with conductor 28 in FIG. 1. The plunger 70 is reciprocally moveable within the bore 70*a* and is urged into the electrically connecting position shown by coil spring 74 so that the leading end 72 penetrates the elastomeric seal 48 as shown and makes electrical contact with the conductor ring 28. A hydraulic port 76 is disposed in the housing of the assembly 32 for receiving a hydraulic line (not shown in the interests of clarity). When pressure is applied to the hydraulic line, the plunger 70 is moved to the right, against the force of coil spring 74, so that the penetrator 72 is retracted from its engagement with the conductor ring assembly. When this occurs the resilience of the elastomeric ring 48 seals the hole made by the leading end of the penetrator 72*a* to prevent ingress of well fluid making contact with the conductor ring 28. The electrical connector 72 is connected via a cable (not shown) in bore 77 to typically a Tronic (Ulverston, U.K.) four way connector 78, which can, in turn, receive a mating coupling, not shown, to convey electrical signals to and from the penetrator 72.

A manually operable plunger retraction assembly, generally indicated by reference numeral 80, is disposed at the outermost end of the assembly 32. This can be actuated manually or by a ROV to retract the penetrator 72 and plunger 70 into the assembly 32 in the event of failure of hydraulic pressure. In the event hydraulic pressure does fail, the electrical connector assembly is designed as a "fail-connect" system, whereby the coil spring 74 urges the plunger and connector/penetrator 72*a* into electrical contact with the conductor ring so that there is electrical continuity throughout the system. In the position shown in FIG. 1 electrical connection is thereby possible via the four way connector 78 through the penetrator 72, the leading end of the penetrator 72*a* to the conductor ring 28 and the electrical connector 39 and cable 40.

It will be appreciated that in this arrangement the connector assembly can be disposed at any position around the wellhead at a suitable level so that when the connector/penetrator 72*a* is actuated to penetrate the elastomeric ring 48 it makes electrical contact with the conductor ring 28. Therefore, this effectively allows 360° connection around the wellhead and thus the connection is independent of tubing hanger orientation. In addition, because the penetrator assembly is mounted as shown connection is made horizontally through the wellhead to mate with the conductor ring 28 instead of a vertical stab connection as in the prior art. This means that less machining of the tubing hanger and tubular connections is required to create longitudinal bores, such as bore 38 and 42, minimising cost and minimising possible damage to the components in the event of misalignment. In this case, misalignment is minimised because the electrical connector assembly can only be fitted at one location and the tubing hanger can only be disposed in the wellhead at one level so that when the electrical connector assembly is actuated, penetration occurs at the correct level so that electrical connection is made between the penetrator and the conductor ring.

Reference is now made to FIG. 3 of the drawings which depicts the entire tubing hanger 20 (DrillQuip) from which it will be seen that the bore 42 extends the length of the tubing hanger. The wellhead 20, the conductor assembly 26 and the electrical connector assembly are shown in broken outline. It will be seen that the tubing hanger has a circumferential locating ring 22*a* for locating the tubing hanger in the wellhead at the correct location to allow registration of the electrical connector assembly 32 and the conductor ring assembly 28 as described above.

Various modifications may be made to the embodiment hereinbefore described without departing from the scope of the invention. The invention may be applied to providing electrical connection between tubular elements within a well where non-orientation is required between respective adjacent tubular elements which are screwed or otherwise coupled together. The tubular elements are of different diameters to facilitate transverse of horizontal penetration by the penetrator through the elastomeric ring. The ring is conveniently on the lower tubular element and at that level is of a smaller diameter than the diameter of the element at the level of the penetrator so that the top tubular element fits over the lower element before penetration occurs. In an alternative arrangement the lower element may be of a larger diameter and the top tubular element smaller at the penetrator/ring level so that it fits inside the lower element. The conductor ring assembly may be disposed in any suitable tubular element as long as there is registration between the location of the tubular element and the location of the electrical connector assembly so that when both are disposed in oil well apparatus and actuation of the plunger 70 occurs there is registration between the penetrator 72 and the conductor ring 28. The plunger 70 may be pneumatically or electrically controlled instead of hydraulically controlled. The conductor ring may be made of any suitable conducting material, other than copper, for example steel, or a conductive polymer. The elastomer 48 may be replaced by any suitable elastomeric material which provides electrical insulation and is sufficiently resilient to seal holes made by a penetrator upon the retraction. The wave springs may be replaced by disc springs.

It will be appreciated that the principal advantage of the present invention is that it provides for electrical connection through a tubular element which does not depend on the orientation of a stack of tubular elements, thus facilitating rapid and effective assembly of subsea components avoiding the requirement of orientation. Therefore, the provision of an orientation-free system minimise cost. In addition, the use of a horizontal electrical connection avoids the need for complex machining of bores in tubular elements and is a particular advantage where tubular elements are relatively thin walled, thus minimising machine costs and allowing for electrical connection to be made in such think walled tubular elements which hitherto have not been able to receive electrical connection. The invention has particular application in subsea assemblies for permanent monitoring and intelligent well completion.

What is claimed is:

1. A wellhead electrical connector system for use with a wellhead, said electrical connector system having a tubular element for location in said wellhead, said tubular element having a generally circumferentially extending electrical conductor ring assembly disposed at one end thereof, said electrical conductor ring assembly having an electrical conductor ring which is electrically insulated from the tubular element, a generally circumferential elastomeric sealing ring disposed about the electrical conductor ring for electrically insulating said conductor ring from the tubular element and from the external environment, said tubular element having at least one electrical connector disposed in a wall of said tubular element thereof for conveying electrical signals to electrical conductors adapted to be coupled thereto, said elastomeric sealing ring being penetrable by an energisable electrical connector coupled to the wellhead to contact said conductor ring and provide an electrical connection from the energisable electrical connector through the tubular element to said at least one electrical connector disposed within said tubular element.

2. A wellhead electrical connector system as claimed in claim 1 wherein the elastomeric ring is shaped to allow expansion when compressed by the retainer ring so as to provide effective sealing against an interior surface of the wellhead and minimise the intrusion of well fluids between an elastomeric sealing ring surface and an opposed surface of the interior of the wellhead.

3. A wellhead electrical connector system as claimed in claim 1 wherein the elastomeric ring is a machined element.

4. A wellhead electrical connector system as claimed in claim 1 wherein the electrical connector system is electrically coupled to a multi-way connector for conveying electrical signals from a source external to the connector assembly through the connector assembly to the conductor ring when in use.

5. A wellhead electrical connector system as claimed in claim 1 wherein the energizable electrical connector is coupled to a manual/ROV override boss which allows the connector to be disengaged from the conductor ring in the event of hydraulic failure.

6. A wellhead electrical connector system as claimed in claim 1 wherein the elastomeric ring is a molded element.

7. A wellhead electrical connector system as claimed in claim 1 wherein the tubular element is a tubing hanger.

8. A wellhead electrical connector system as claimed in claim 7 wherein the tubing hanger further comprises a machined upper end for receiving the conductor ring assembly, such that when the conductor ring assembly is fitted to the tubing hanger, an external diameter of the tubing hanger is substantially the same as prior to machining the tubing hanger.

9. A wellhead electrical connector system as claimed in claim 7 wherein the conductor ring assembly further comprises an annular structure with the conductor ring and elastomeric ring being retained between a lower conductor ring housing and an upper retaining ring, the elastomeric ring being forced onto the conductor ring via the upper retainer ring acting through a spring onto a spring energiser ring which abuts the circumferential elastomeric sealing ring.

10. A wellhead electrical connector system as claimed in claim 9 wherein the entire assembly is retained by an upper annular hanger lock ring which forces the retainer ring and spring and spring energiser ring against the elastomeric ring.

11. A wellhead electrical connector system as claimed in claim 9 wherein the spring is a wave spring.

12. A wellhead electrical connector system as claimed in claim 9 wherein the spring is a disc spring.

13. An electrical conductor ring assembly for use with a downhole tubular element having an electrical connector in a wall thereof and at least one annular bore for receiving an electrical conductor, said conductor ring assembly being adapted to be coupled to said tubular element, said conductor ring assembly having a generally circumferential conductor ring element, a generally circumferential insulating element for electrically insulating said conductor ring assembly from the tubular element, a generally circumferential elastomeric electrically insulating element adapted to be disposed radially externally to the conductor ring assembly for effectively sealing the conductor ring assembly from external well fluids, the conductor ring assembly having upper and lower support means for urging said elastomeric element into contact with said conductor ring, said conductor ring assembly being adapted to be coupled to an electrical conductor for fitting into said bore of said tubular element, said elastomeric element being resilient such that it deforms to allow an electrical penetrator to make electrical contact with said conductor ring, and upon the removal of said electrical penetrator, the elastomeric element recovers to seal the previously penetrated area.

14. A non-orientation required electrical connector system for use with concentric tubular elements coupled together for use within a well, said electrical connector system having a first and a second tubular element for location in said well, said first tubular element having a first coupling portion of a first diameter having a generally circumferentially extending electrical conductor ring assembly disposed at said portion, said electrical conductor ring assembly having an electrical conductor ring which is electrically insulated from the first tubular element housing, a generally circumferential elastomeric sealing ring disposed about the said electrical conductor ring for electrically insulating said conductor ring from the first tubular element and from the external environment, said first tubular element having at least one electrical connector disposed in a wall of said first tubular element thereof for conveying electrical signals to electrical conductors adapted to be coupled thereto, said second tubular element having a second coupling portion of a second diameter different from the diameter of said first coupling portion and being adapted to be coupled to the first coupling portion of said first tubular element, said second tubular element having an energisable electrical connector coupled thereto, the arrangement being such that when said first and second tubular elements are coupled together at said first and second coupling portions, said energisable electrical connector penetrates said elastomeric sealing ring to contact said conductor ring and provide an electrical connection from the energisable electrical connector from the second tubular element to said at least one electrical conductor within said first tubular element.

15. A connector system as claimed in claim 14 wherein the first coupling portion of the first tubular element is of a smaller diameter than the second coupling portion of the second tubular element.

16. A connector system as claimed in claim 14 wherein the first coupling portion of the first tubular element is of a larger diameter than the second coupling portion of the second tubular element.

* * * * *